US011276963B2

(12) United States Patent
Shimizu

(10) Patent No.: US 11,276,963 B2
(45) Date of Patent: Mar. 15, 2022

(54) CONNECTOR AND CONNECTOR DEVICE

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventor: Toru Shimizu, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/057,895

(22) PCT Filed: May 20, 2019

(86) PCT No.: PCT/JP2019/019859
§ 371 (c)(1),
(2) Date: Nov. 23, 2020

(87) PCT Pub. No.: WO2019/235197
PCT Pub. Date: Dec. 12, 2019

(65) Prior Publication Data

US 2021/0336390 A1 Oct. 28, 2021

(30) Foreign Application Priority Data

Jun. 4, 2018 (JP) ..... JP2018-107134

(51) Int. Cl.
*H01R 13/631* (2006.01)
*H01R 13/15* (2006.01)
(Continued)

(52) U.S. Cl.
CPC ..... *H01R 13/631* (2013.01); *H01R 13/15* (2013.01); *H01R 13/2407* (2013.01); *H01R 13/502* (2013.01); *H01R 24/66* (2013.01)

(58) Field of Classification Search
CPC .. H01R 13/631; H01R 13/15; H01R 13/2407; H01R 24/66
See application file for complete search history.

(56) References Cited

U.S. PATENT DOCUMENTS 7,268,300 B2 * 9/2007 Miyazaki ..... H01R 13/62905 174/138 F
7,628,629 B2 12/2009 Miyazaki et al.
(Continued)

FOREIGN PATENT DOCUMENTS

JP 2000-182696 A 6/2000

OTHER PUBLICATIONS

International Search Report dated Aug. 6, 2019 for WO 2019/235197 A1 (3 pages).

*Primary Examiner* — Abdullah A Riyami
*Assistant Examiner* — Nader J Alhawamdeh
(74) *Attorney, Agent, or Firm* — Abelman, Frayne & Schwab

(57) ABSTRACT

A connector disclosed by this specification is provided with a terminal constituted of a conductive metal member, a housing made of resin, the terminal being accommodated into the housing, and a spring clip (biasing member) to be mounted on the terminal. The terminal includes a plate-like first terminal including a first connecting portion to be connected to a first mating connecting portion (mating connecting portion) in a first direction and a first contact portion continuously provided from the first connecting portion, and a plate-like second terminal to be fixed to the housing and including a second contact portion disposed to be able to contact the first contact portion in the first
(Continued)

direction. The spring clip biases and electrically connects the first and second contact portions to each other and makes the first terminal relatively displaceable in a direction intersecting the first direction with respect to the second terminal.

5 Claims, 11 Drawing Sheets

(51) Int. Cl.
*H01R 13/24* (2006.01)
*H01R 13/502* (2006.01)
*H01R 24/66* (2011.01)

(56) References Cited

U.S. PATENT DOCUMENTS 8,272,887 B2 * 9/2012 Fukuda ..... H01R 31/06 439/372
8,545,265 B2 * 10/2013 Sakamoto ..... B29C 45/14467 439/606
9,004,928 B2 * 4/2015 Tanaka ..... B60L 3/0069 439/86
9,882,315 B2 * 1/2018 Neureiter ..... H01R 13/6581
10,116,093 B2 10/2018 Ishibashi
10,811,810 B2 * 10/2020 Nishijima ..... H01R 13/5202
11,165,176 B2 * 11/2021 Seo ..... H01R 9/223
2010/0203776 A1 8/2010 Zhao
2012/0052734 A1 * 3/2012 Fukuda ..... H01R 13/639 439/626
2012/0264318 A1 10/2012 Ishikawa
2013/0040473 A1 * 2/2013 Tanaka ..... H01R 24/68 439/86
2013/0196558 A1 8/2013 Adachi et al.
2014/0322973 A1 * 10/2014 Okamoto ..... H01R 13/4223 439/587
2015/0311639 A1 * 10/2015 Neureiter ..... H02K 11/0094 310/71
2016/0294089 A1 10/2016 Kobayashi et al.
2019/0103695 A1 4/2019 Kimura et al.
2019/0379154 A1 * 12/2019 Nishijima ..... H01R 13/512
2021/0336390 A1 * 10/2021 Shimizu ..... H01R 13/15

* cited by examiner

CONNECTOR AND CONNECTOR DEVICE

CROSS REFERENCE TO RELATED APPLICATIONS

This application is a national phase of PCT application No. PCT/JP2019/019859, filed on 20 May 2019, which claims priority from Japanese patent application No. 2018-107134, filed on 4 Jun. 2018, all of which are incorporated herein by reference.

TECHNICAL FIELD

A technique disclosed by this specification relates to a connector and a connector device.

BACKGROUND

An inverter-side connector described in Patent Document 1 below is known as an example of a conventional connector. This inverter-side connector includes a female housing made of synthetic resin, three inverter-side terminals to be mounted into the female housing, and a back retainer for retaining and holding the inverter-side terminals. The inverter-side terminal is structured such that a female terminal to be connected to a mating motor-side terminal and a BA terminal to be connected to an outer terminal of an inverter are connected via a braided wire.

If there is a deviation between a mount position of the inverter-side connector and the position of a terminal block in which the BA terminals of the inverter-side terminals are disposed, the braided wires can absorb a positional deviation while being expanded or contracted.

PRIOR ART DOCUMENT

Patent Document

Patent Document 1: JP 2016-140186 A

SUMMARY OF THE INVENTION

Problems to be Solved

However, since the braided wires need to be provided between the female terminals and the BA terminals to absorb the positional deviation, a configuration becomes complicated. Further, the inverter-side connector becomes larger by lengths of the braided wires.

Means to Solve the Problem

A connector disclosed in this specification is provided with a terminal constituted of a conductive metal member, a housing made of resin, the terminal being accommodated into the housing, and a biasing member to be mounted on the terminal, wherein the terminal includes a plate-like first terminal including a first connecting portion to be connected to a mating connecting portion in a first direction and a first contact portion continuously provided from the first connecting portion, and a plate-like second terminal to be fixed to the housing and including a second contact portion disposed to be able to contact the first contact portion in the first direction, and the biasing member biases and electrically connects the first and second contact portions to each other and makes the first terminal relatively displaceable in a direction intersecting the first direction with respect to the second terminal.

Since the first terminal is relatively displaceable in the direction intersecting the first direction with respect to the second terminal, even if there is a positional deviation between the first connecting portion and the mating connecting portion, the positional deviation is absorbed and the first connecting portion and the mating connecting portion can be connected by a relative displacement of the first terminal with respect to the second terminal. A first connecting portion and a first contact portion are conventionally connected by a braided wire to absorb a positional deviation by the braided wire, whereas the positional deviation between the first connecting portion and the first mating connecting portion can be absorbed without using a braided wire by the above configuration in this way.

Further, the biasing member may be a spring clip made of metal and configured to bias the first and second contact portions in directions opposite to each other by pressing the first contact portion in a direction from the first contact portion toward the second contact portion and pressing the second contact portion in a direction from the second contact portion toward the first contact portion, the spring clip may include a plate-like first pressing portion configured to press the first contact portion, a plate-like second pressing portion configured to press the second contact portion, and a coupling portion coupling the first and second pressing portions, and a gap may be provided between the first contact portion and the coupling portion.

Since the gap is provided between the first contact portion and the coupling portion, the first terminal becomes displaceable in a moving direction of the first contact portion toward the coupling portion.

Further, the housing may include an insertion hole larger than an outer shape of the first connecting portion, and the terminal may restrict a displaceable range of the first terminal within a range of the insertion hole by being accommodated into the housing with the first connecting portion inserted in the insertion hole.

By restricting the displaceable range of the first terminal within the range of the insertion hole, it can be, for example, suppressed that the first terminal is largely displaced and detached from the spring clip.

Further, the housing may include a bottomed receptacle open in the first direction and a plate-like separate lid to be accommodated into the receptacle from the first direction, the first terminal may be located in the receptacle and the biasing member may be located between a bottom surface of the receptacle and the lid, and the lid may be provided with the insertion hole and an outer peripheral edge of the lid may be in contact with an inner surface of the receptacle.

By providing the insertion hole in the lid separate from the housing and accommodating the lid into the receptacle of the housing, it does not take time and effort, for example, to protect the first connecting portion so that resin is not fixed to the first connecting portion as compared to a configuration in which an insertion hole is integrally formed in a housing by insert molding, wherefore the insertion hole can be easily provided. Further, since the biasing member is located between the bottom surface of the receptacle and the lid, it can be made possible to prevent the biasing member from being visually confirmed through an opening of the receptacle.

Further, a connector device disclosed in this specification is provided with the above connector and a mating connector connectable to the connector in the first direction, wherein the mating connector may include a mating housing to be connected to the housing, the mating housing may include a bottomed mating receptacle open in a second direction opposite to the first direction, the receptacle of the housing being accommodated into the mating receptacle when the housing and the mating housing are connected, and an accommodating portion projecting in the second direction from a bottom surface of the mating receptacle, the mating connecting portion being accommodated into the accommodating portion, a mating insertion hole into which the first connecting portion is inserted may be provided to be open in an end surface in the second direction of the accommodating portion, and a tapered surface expanded in the second direction and configured to guide the first connecting portion into the mating insertion hole may be provided on an opening edge part of the mating insertion hole.

If there is a positional deviation between the first connecting portion and the mating connecting portion when the housing and the mating housing are connected, the end part in the first direction of the first connecting portion contacts the tapered surface of the accommodating portion. At this time, the end part in the first direction of the first connecting portion and the tapered surface slide against each other, the first terminal is relatively displaced with respect to the second terminal and the first connecting portion is guided into the mating insertion hole of the accommodating portion. By providing the tapered surface in this way, the first connecting portion of the first terminal can be guided into the mating insertion hole.

Effect of the Invention

According to the connector disclosed in this specification, a positional deviation between the first connecting portion of the first terminal and the mating connecting portion to be connected to the first connecting portion can be absorbed without using a braided wire.

DETAILED DESCRIPTION TO EXECUTE THE INVENTION

Embodiment

A connector device 10 in an embodiment is described with reference to FIGS. 1 to 11. In the following description, an upward direction (first direction), a rightward direction and a forward direction are based on those shown in FIGS. 1 to 11.

Figure 1:
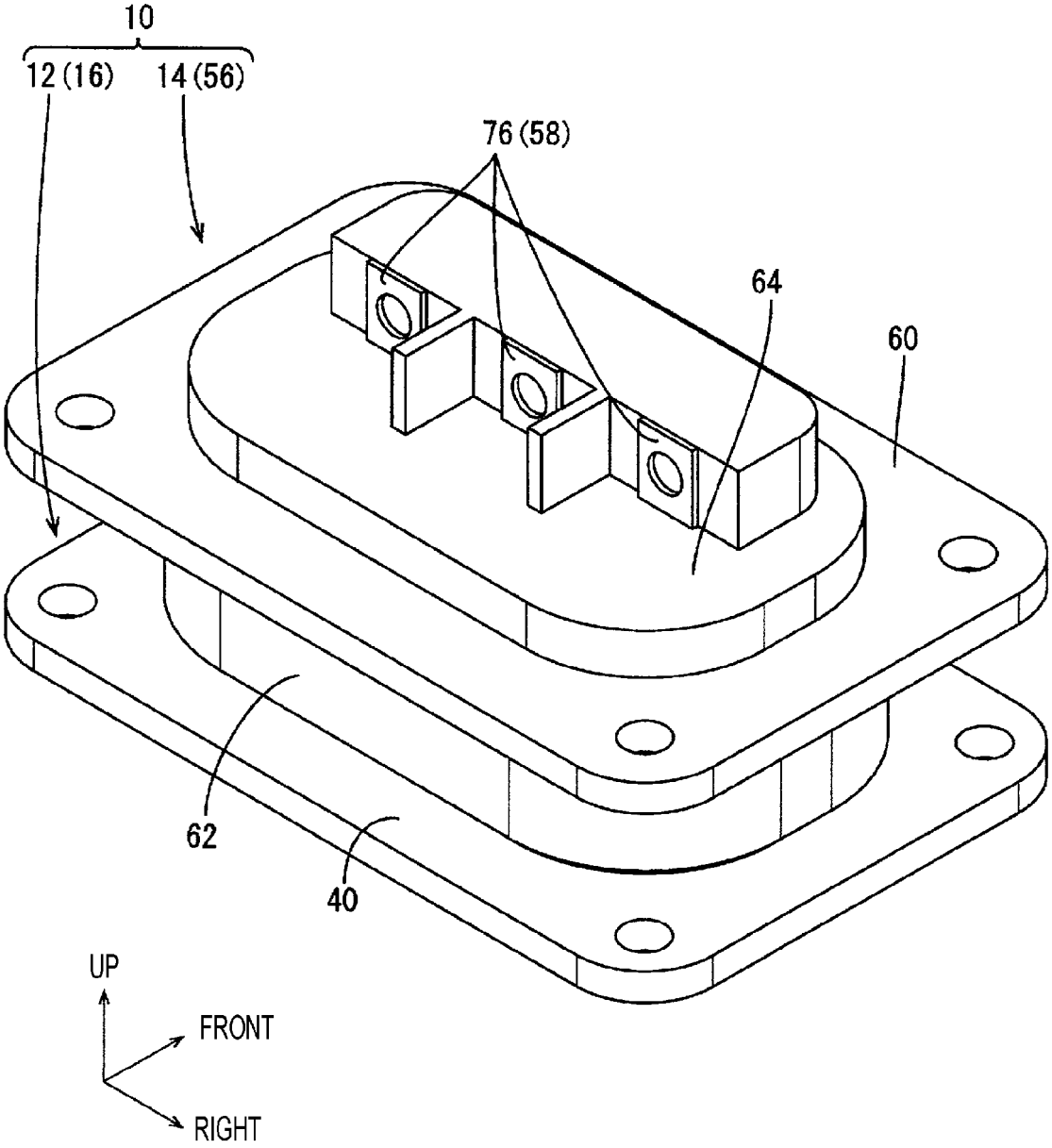
FIG. 1 is a perspective view of a connector device in an embodiment.
Figure 2:
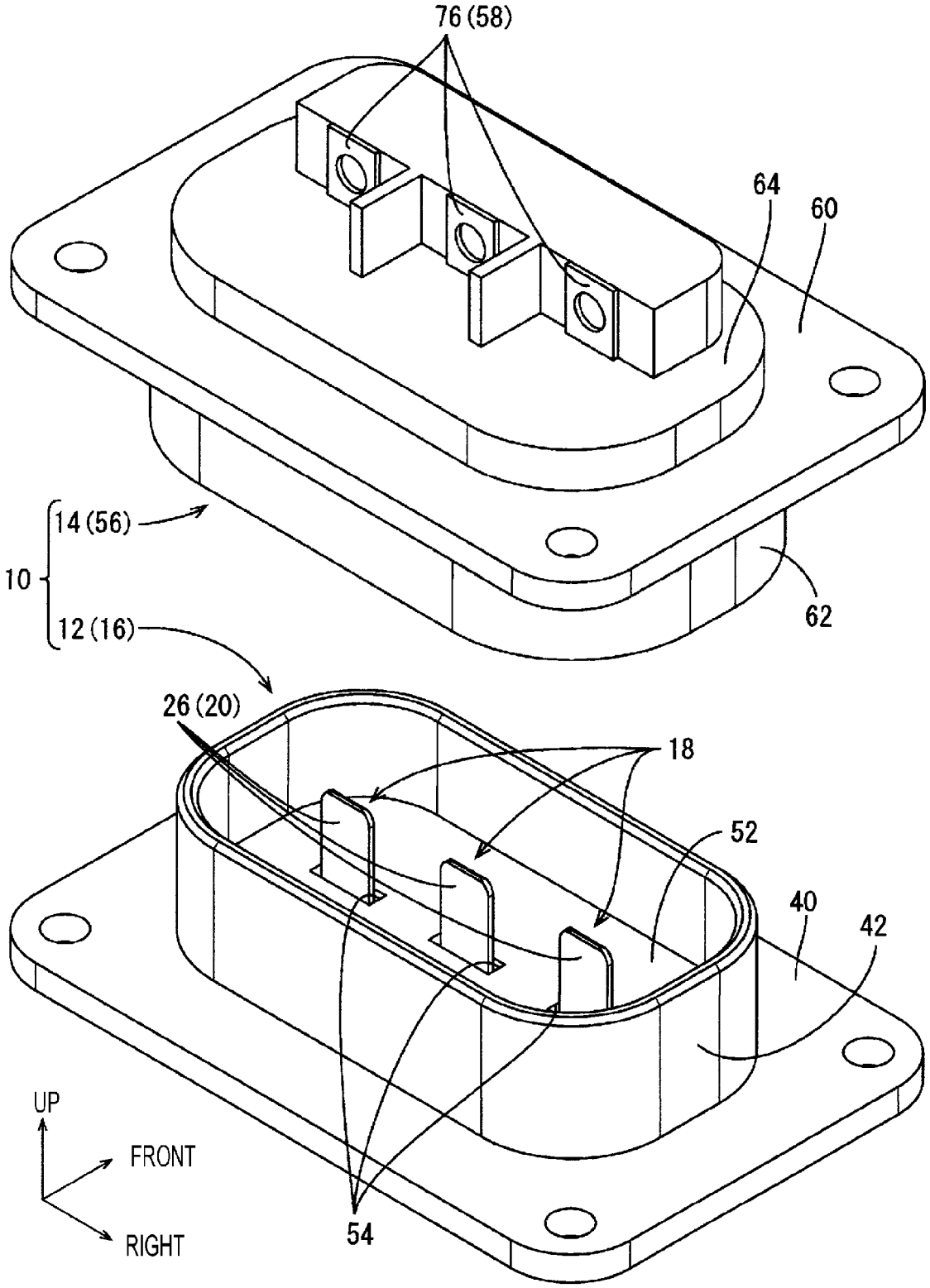
FIG. 2 is a perspective view before a connector and a mating connector are connected.
Figure 3:
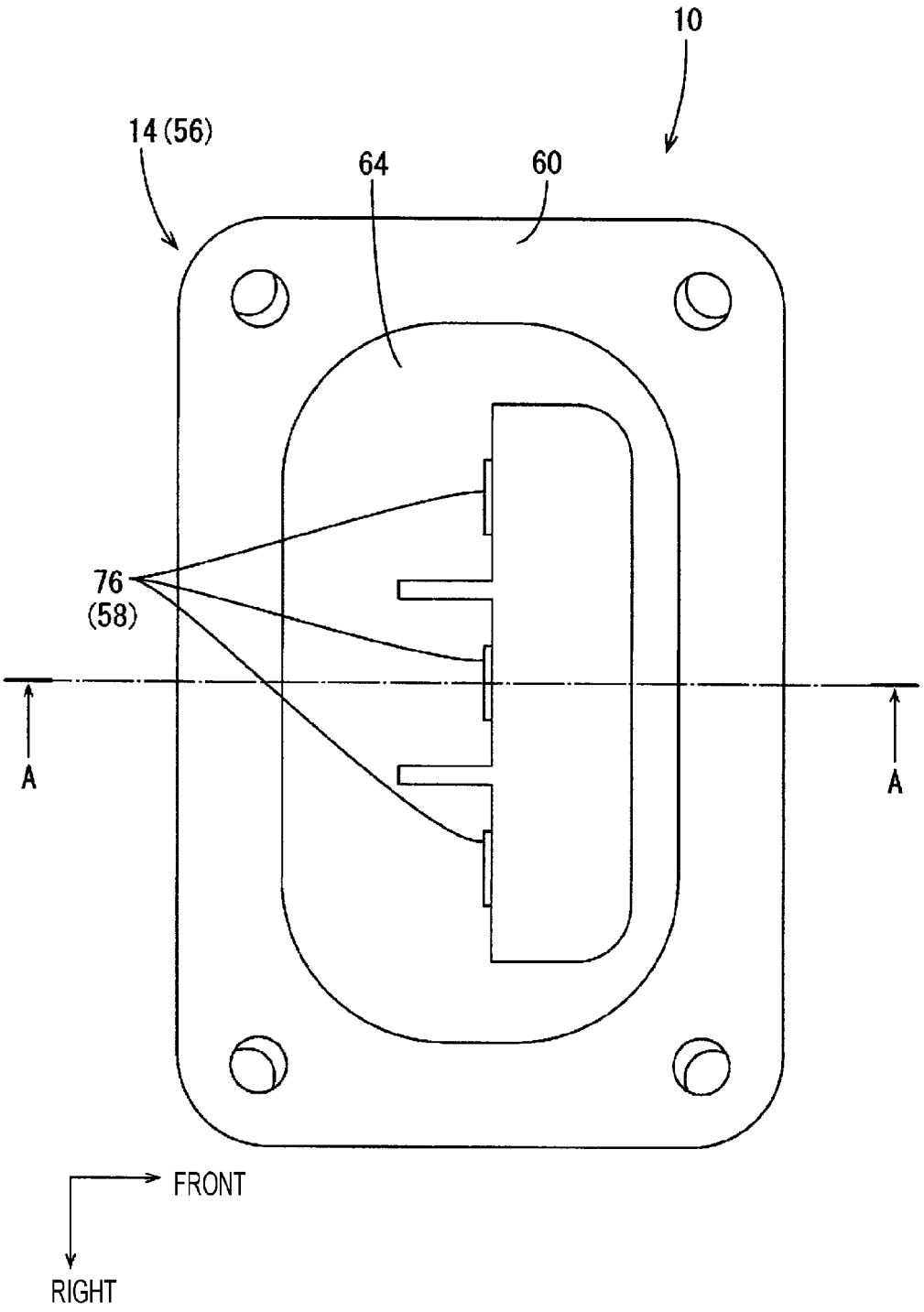
FIG. 3 is a plan view of the connector device.

The connector device 10 is for electrically connecting one device (e.g. inverter) and another device (e.g. motor) and, as shown in FIGS. 1 and 2, composed of a connector 12 and a mating connector 14 to be connected to the connector 12. As shown in FIG. 2, the connector 12 includes a housing 16 made of resin and three terminals 18.

Figure 9:
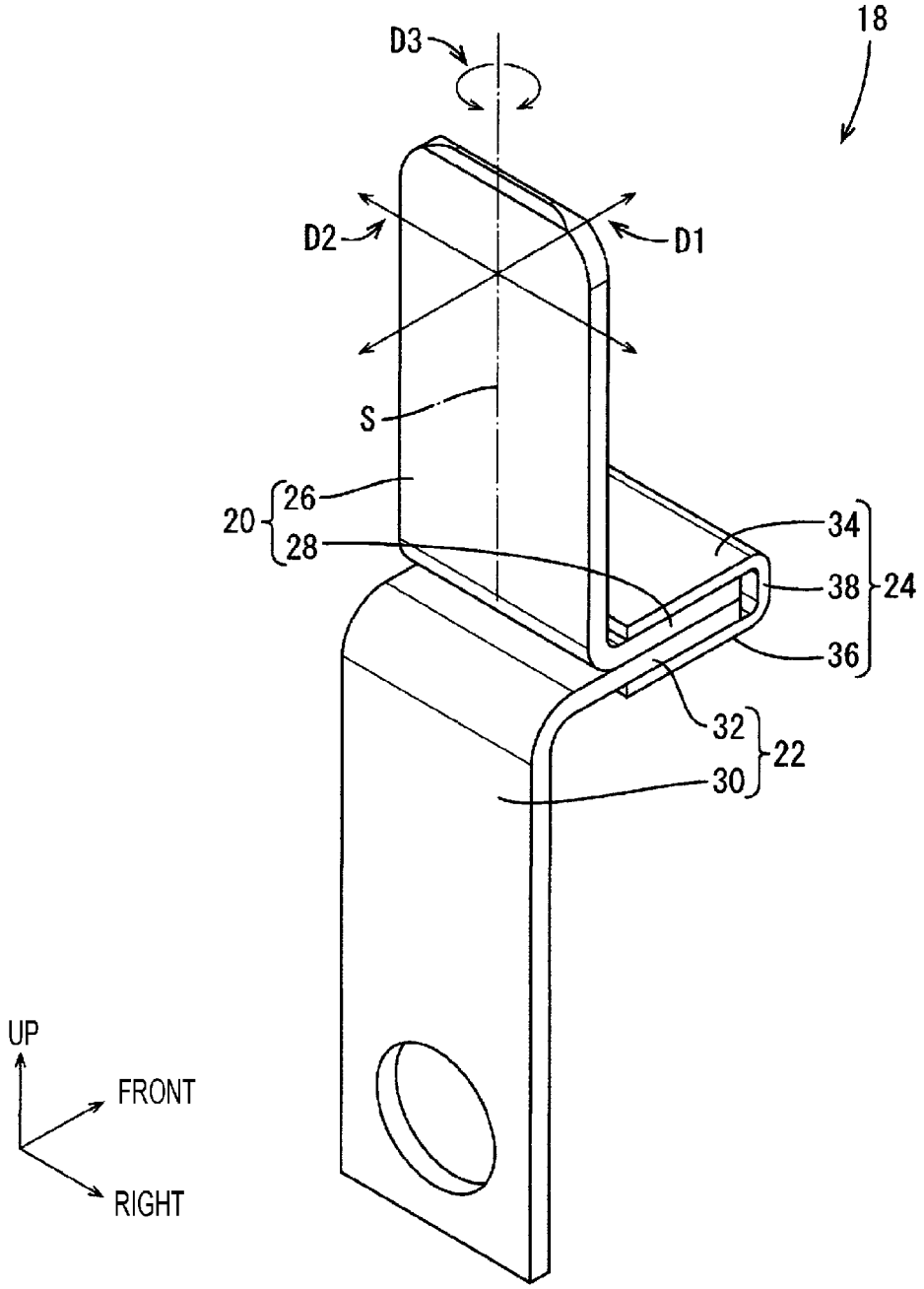
FIG. 9 is a perspective view of a terminal.
Figure 11:
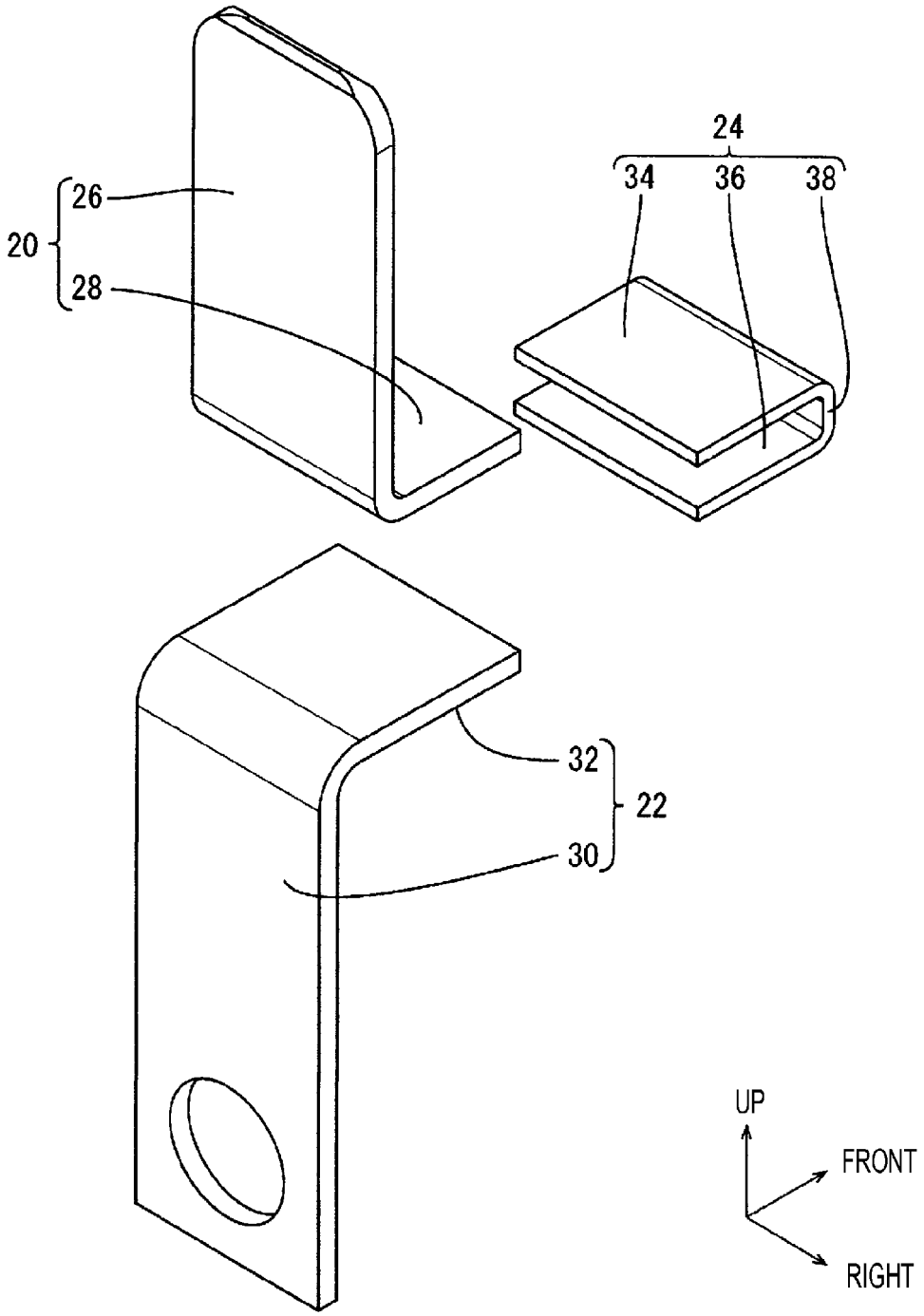
FIG. 11 is an exploded perspective view of the terminal.

As shown in FIGS. 9 and 11, the terminal 18 is composed of an L-shaped first terminal 20, an L-shaped second terminal 22 and a spring clip (biasing member) 24.

The first terminal 20 is constituted of a member made of conductive metal (e.g. copper alloy) and includes, as shown in FIG. 9, a plate-like first connecting portion 26 extending upward and a plate-like first contact portion 28 continuously provided from the first connecting portion 26 and projecting forward from a lower end part of the first connecting portion 26.

The second terminal 22 is constituted of a member made of conductive metal (e.g. copper alloy) and includes a plate-like second connecting portion 30 extending downward and a plate-like second contact portion 32 projecting forward from an upper end part of the second connecting portion 30. A fastening hole to be fastened to a device side is provided to be open in a lower part of the second connecting portion 30. The lower surface of the first contact portion 28 of the first terminal 20 and the upper surface of the second contact portion 32 of the second terminal 22 are in contact with each other.

The spring clip 24 is constituted of a member made of metal (e.g. SUS: Steel Use Stainless) and includes a plate-like first pressing portion 34 for pressing the upper surface of the first contact portion 28 from above, a plate-like second pressing portion 36 for pressing the lower surface of the second contact portion 32 from below, and a coupling portion 38 coupling the front end of the first pressing portion 34 and that of the second pressing portion 36. The first and second contact portions 28, 32 are biased in directions opposite to each other and the first and second terminals 20, 22 are electrically connected by the spring clip 24.

Figure 4:
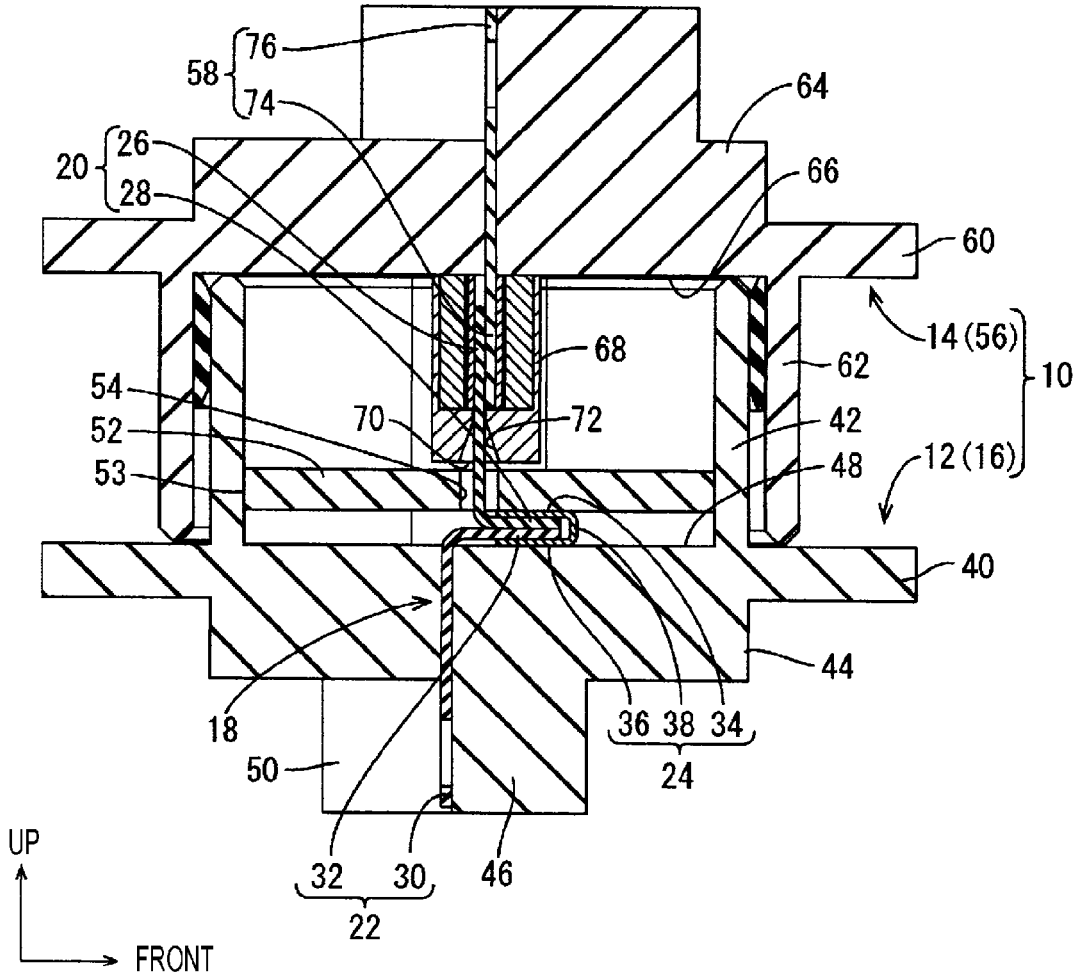
FIG. 4 is a section along A-A in FIG. 3.

As shown in FIG. 4, a part of the second connecting portion 30 of the second terminal 22 is embedded in the housing 16 by insert molding, whereby the second terminal 22 is fixed to the housing 16. Further, the spring clip 24 is so fixed as not to be displaced in a front-rear direction and a lateral direction by an unillustrated fixing portion provided in the housing 16.

A biasing force of the spring clip 24 is such that the first terminal 20 can be relatively displaced with respect to the second terminal 22 due to the first contact portion 28 sliding on the lower surface of the first pressing portion 34 and the upper surface of the second contact portion 32 of the spring clip 24 when a stress is applied to the first terminal 20 in a direction intersecting the vertical direction. In this way, the first terminal 20 is relatively displaceable in a front-rear direction D1, a lateral direction D2 and a rotating direction D3 about an axis S in the vertical direction of the first connecting portion 26 with respect to the second terminal 22 as shown in FIG. 9.

Figure 10:
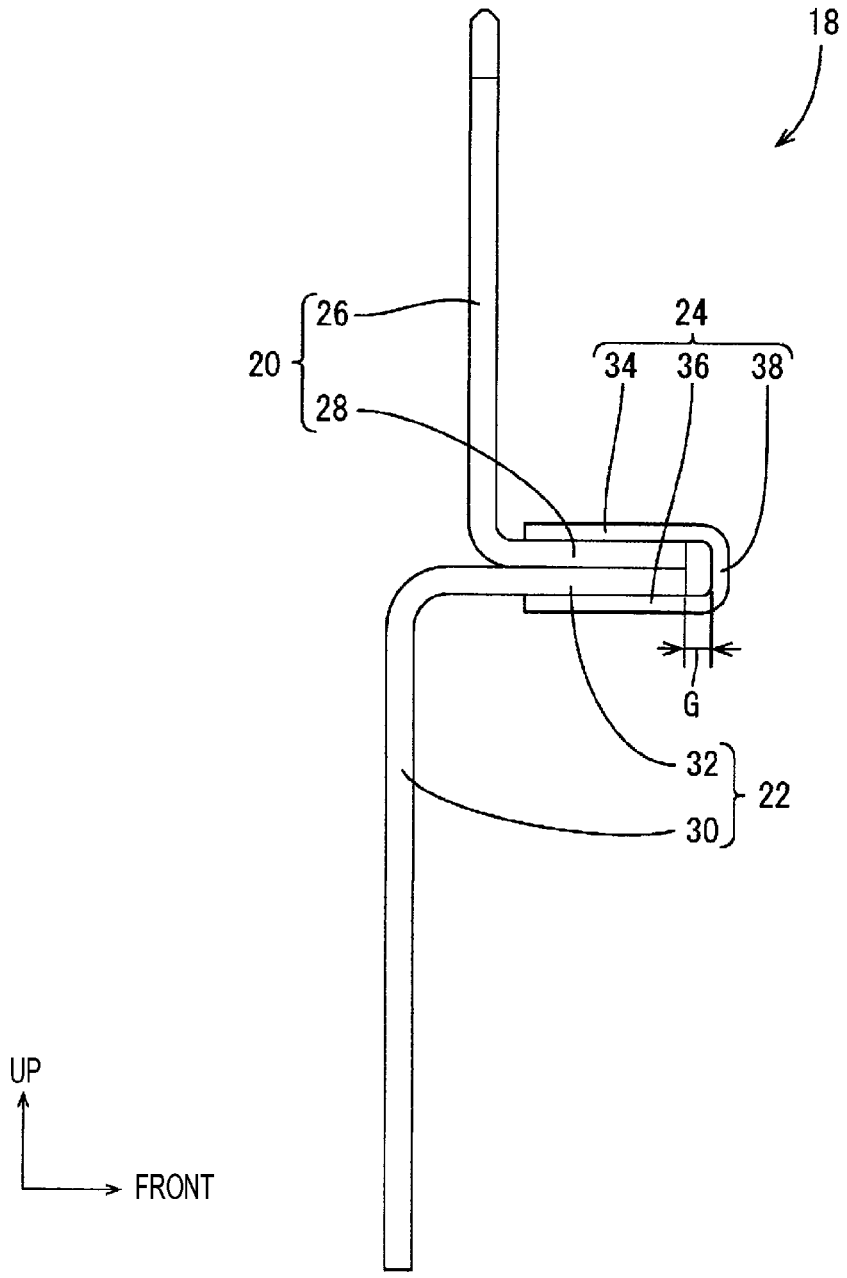
FIG. 10 is a side view of the terminal.

As shown in FIG. 10, a length in the front-rear direction of the second contact portion 32 is set longer than that of the first contact portion 28, thereby expanding a range in which the first terminal 20 can be displaced rearward. Further, a length in the lateral direction of the second contact portion 32 is set substantially equal to that of the first contact portion 28. Further, a gap G is provided between the front ends of the first and second contact portions 28, 32 and the coupling portion 38 of the spring clip 24, and the first terminal 20 can be displaced forward.

As shown in FIG. 4, the housing 16 includes a plate-like mounting plate 40, a receptacle 42 projecting upward from the upper surface of the mounting plate 40 and open upward, a base end portion 44 projecting downward from the lower surface of the mounting plate 40 and a projecting portion 46 projecting downward from the lower surface of the base end portion 44. As shown in FIG. 2, the mounting plate 40 is in the form of a rectangular plate, and mounting holes are respectively provided to be open in four corners of a plate surface. Here, a surface within an opening of the receptacle 42 on the upper surface of the mounting plate 40 serves as a bottom surface 48 of the receptacle 42.

Figure 7:
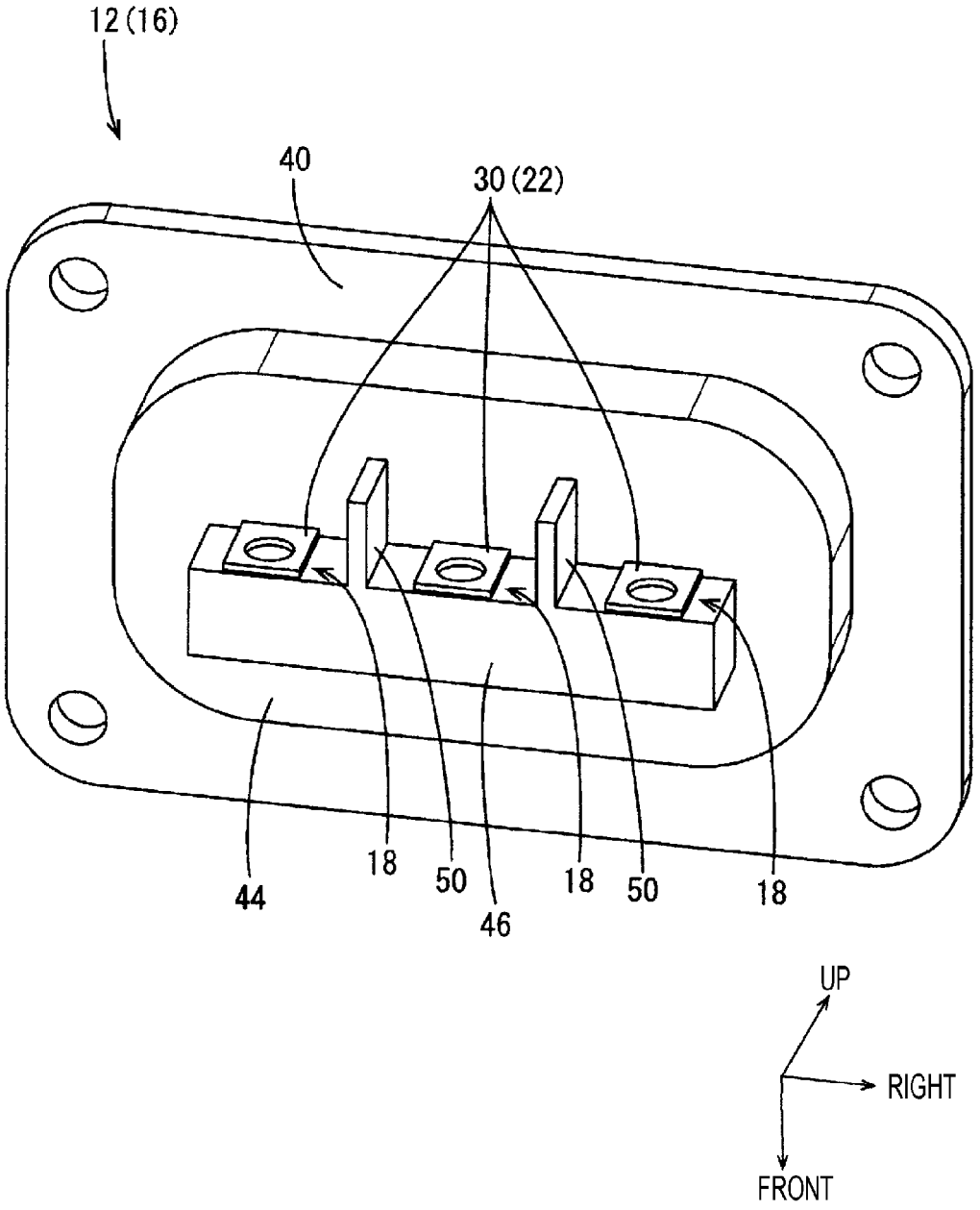
FIG. 7 is a perspective view of the connector viewed from below.

As shown in FIGS. 2 and 7, three terminals 18 are disposed at predetermined intervals in the lateral direction. As shown in FIG. 2, the three first terminals 20 are respectively located in the opening of the receptacle 42 and can be visually confirmed through the opening of the receptacle 42.

As shown in FIG. 4, the lower surface of the second pressing portion 36 of the spring clip 24 is in contact with the bottom surface 48 of the receptacle 42.

As shown in FIG. 4, a part of the second connecting portion 30 of the second terminal 22 is embedded in the mounting plate 40 and the base end portion 44 of the housing 16, and a lower part of the second connecting portion 30 is exposed downward from the lower surface of the base end portion 44. Further, the front surface of the lower part of the second connecting portion 30 is in surface contact with the rear surface of the projecting portion 46. Further, as shown in FIG. 7, partition walls 50 are respectively provided between adjacent ones of the lower parts of three second connecting portions 30. The partition walls 50 project rearward from the rear surface of the projecting portion 46 and are continuous with the lower surface of the base end portion 44.

As shown in FIGS. 2 and 4, a separate lid 52 is accommodated into the opening of the receptacle 42 of the housing 16 from above. The lid 52 is plate-like, and an outer peripheral edge 53 of the lid 52 is in contact with the inner surface of the receptacle 42. The lid 52 is provided with insertion holes 54 respectively open at positions corresponding to the first connecting portions 26 of the three first terminals 20.

The spring clip 24 is located between the lid 52 and the bottom surface 48 of the receptacle 42 as shown in FIG. 4, and cannot be visually confirmed from outside as shown in FIG. 2.

As shown in FIGS. 2 and 4, the insertion hole 54 has an opening larger than the outer shape of the first connecting portion 26. In this way, if the first terminal 20 is largely relatively displaced with respect to the second terminal 22, the first connecting portion 26 comes into contact with the inner surface of the insertion hole 54 to restrict a displacement of the first terminal 20. In this way, the first terminal 20 is suppressed from being largely relatively displaced with respect to the second terminal 22 and detached from the spring clip 24. Further, for example, in the case of providing these insertion holes 54 integrally to a housing by insert molding, protection to prevent resin from being fixed to the outer periphery of the first connecting portion 26 is necessary and it takes time and labor. However, by providing the insertion holes 54 in the separate lid 52 as in this embodiment, the insertion holes 54 can be easily provided.

As shown in FIG. 1, the mating connector 14 includes a mating housing 56 made of resin and to be connected to the housing 16, and three mating terminals 58. As shown in FIG. 4, the mating housing 56 includes a plate-like mating mounting plate 60, a mating receptacle 62 projecting downward (second direction) from the lower surface of the mating mounting plate 60 and open downward, and a mating base end portion 64 projecting upward from the upper surface of the mating mounting plate 60. Here, a surface within an opening of the mating receptacle 62 on the lower surface of the mating receptacle 62 serves as a bottom surface 66 of the mating receptacle 62.

If the housing 16 and the mating housing 56 are connected, the receptacle 42 of the housing 16 is accommodated into the opening of the mating receptacle 62 of the mating housing 56 as shown in FIG. 4.

Figure 8:
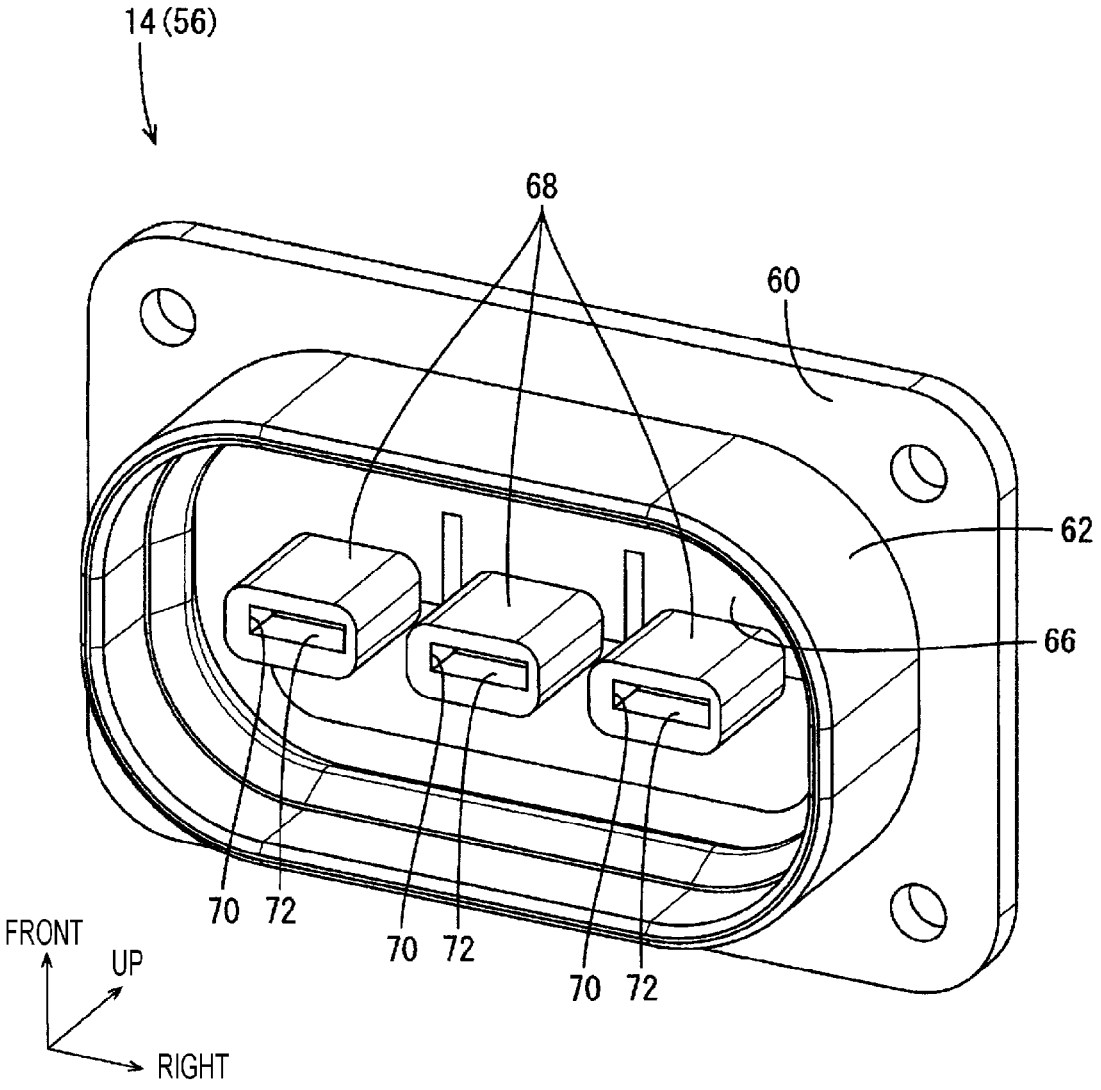
FIG. 8 is a perspective view of the mating connector viewed from below.

As shown in FIG. 8, the mating receptacle 62 is provided with three accommodating portions 68 projecting downward from the bottom surface 66. The three accommodating portions 68 are respectively provided at positions corresponding to the first connecting portions 26 of the three first terminals 20, and mating insertion holes 70 into which the first connecting portions 26 of the first terminals 20 are inserted are provided to be open in the lower end surfaces of the accommodating portions 68. As shown in FIGS. 4 and 8, tapered surfaces 72 expanded toward a lower side are provided on opening edge parts of the mating insertion holes 70.

As show in FIG. 4, the mating terminal 58 is in the form of a plate long in the vertical direction, a lower part of the mating terminal 58 serves as a first mating connecting portion (mating connecting portion) 74 to be connected to the first connecting portion 26, and an upper part of the mating terminal 58 serves as a second mating connecting portion 76 to be connected to a device side.

A part of the mating terminal 58 between the first and second mating connecting portions 74, 76 is embedded in the mating mounting plate 60 and the mating base end portion 64 of the mating housing 56, whereby the mating terminal 58 is fixed to the mating housing 56.

As shown in FIG. 4, the first mating connecting portion 74 of the mating terminal 58 is accommodated in the accommodating portion 68. If the housing 16 and the mating housing 56 are connected and the first connecting portions 26 are inserted through the mating insertion holes 70 of the accommodating portions 68, the first mating connecting portions 74 and the first connecting portions 26 are electrically connected.

Next, functions of this embodiment are described.

Figure 5:
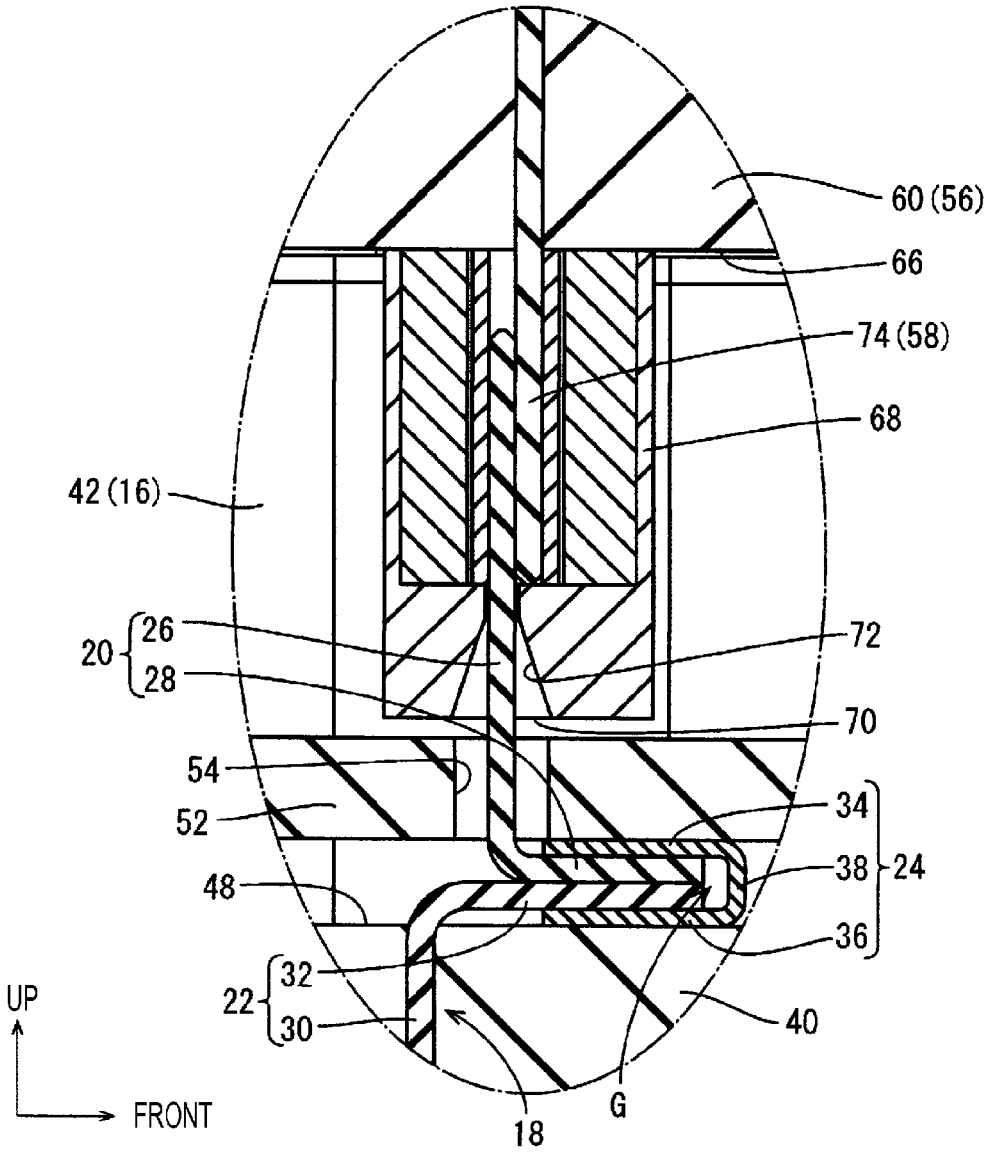
FIG. 5 is a section enlargedly showing the vicinity of a first terminal and a spring clip in FIG. 4.
Figure 6:
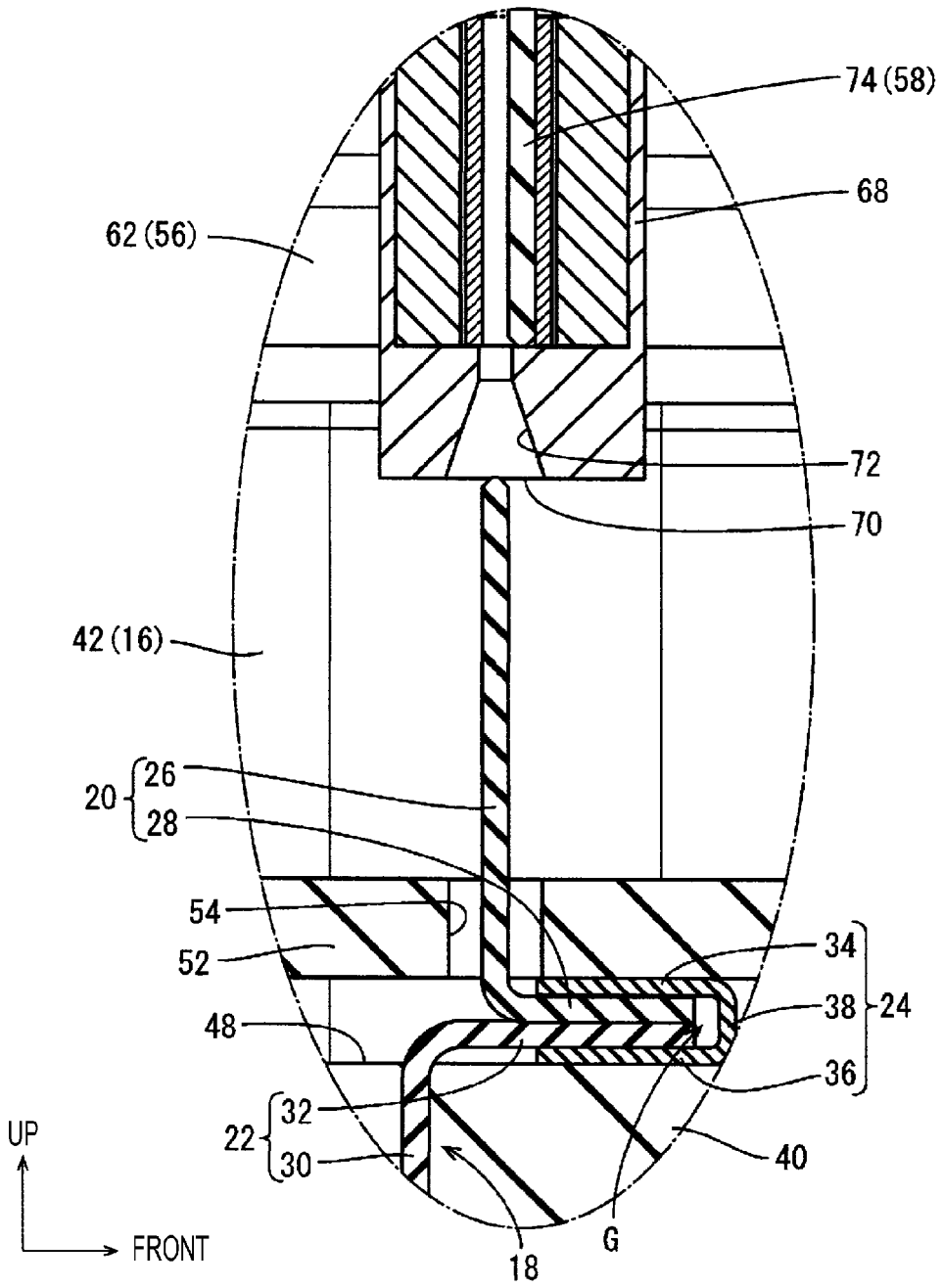
FIG. 6 is a section before the connector and the mating connector are connected in FIG. 5.

From a state shown in FIG. 6, the mating housing 56 is displaced downward to be connected to the housing 16. Here, it is assumed that there is a positional deviation in the lateral direction between the first mating connecting portion 74 and the first connecting portion 26. If the mating housing 56 is displaced downward, an upper end part of the first connecting portion 26 contacts the tapered surface 72 of the accommodating portion 68, the upper end part of the first connecting portion 26 and the tapered surface 72 of the accommodating portion 68 slide against each other, and the first connecting portion 26 is guided into the mating insertion hole 70 while the first contact portion 28 is relatively displaced with respect to the second terminal 22. If the mating housing 56 is further displaced downward, the first connecting portion 26 is accommodated into the accommodating portions 68 and the first connecting portion 26 and the first mating connecting portion 74 contact each other to be electrically connected as shown in FIG. 5. In this way, even if there is a positional deviation between the first connecting portion 26 and the first mating connecting portion 74, the positional deviation is absorbed by a relative displacement of the first terminal 20 with respect to the second terminal 22. A first connecting portion and a first contact portion are conventionally connected by a braided wire to absorb a positional deviation by the braided wire, whereas the positional deviation between the first connecting portion 26 and the first mating connecting portion 74 can be absorbed without using a braided wire in the connector 12 of this embodiment in this way.

As described above, since the first terminal 20 is relatively displaceable in a direction intersecting the first direction with respect to the second terminal 20 according to this embodiment, even if there is a positional deviation between the first connecting portion 26 and the first mating connecting portion (mating connecting portion) 74, the positional deviation can be absorbed and the first connecting portion 26 and the first mating connecting portion (mating connecting portion) 74 can be connected by a relative displacement of the first terminal 20 with respect to the second terminal 22. A first connecting portion and a first contact portion are conventionally connected by a braided wire to absorb a positional deviation by the braided wire, whereas the positional deviation between the first connecting portion 26 and the first mating connecting portion (mating connecting portion) 74 can be absorbed without using a braided wire by the above configuration in this way.

Further, since the gap G is provided between the first contact portion 28 and the coupling portion 38, the first terminal 20 is displaceable in a moving direction of the first contact portion 28 toward the coupling portion 38.

Further, by restricting a displaceable range of the first terminal 20 within a range of the insertion hole 54, it can be, for example, suppressed that the first terminal 20 is largely displaced and detached from the spring clip (biasing member) 24.

By providing the insertion hole 54 in the lid 52 separate from the housing 16 and accommodating the lid 52 into the receptacle 42 of the housing 16, it does not take time and effort, for example, to protect the first connecting portions 26 so that resin is not fixed to the first connecting portions 26 as compared to a configuration in which insertion holes are integrally formed in a housing by insert molding, wherefore the insertion holes 54 can be easily provided. Further, since the spring clip (biasing member) 24 is located between the bottom surface 48 of the receptacle 42 and the lid 52, it can be made possible to prevent the spring clip (biasing member) 24 from being visually confirmed through the opening of the receptacle 42.

Further, if there is a positional deviation between the first connecting portion 26 and the first mating connecting portion (mating connecting portion) 74 when the housing 16 and the mating housing 56 are connected, the upper end part (end part in the first direction) of the first connecting portion 26 contacts the tapered surface 72 of the accommodating portion 68. At this time, the upper end part (end part in the first direction) of the first connecting portion 26 and the tapered surface 72 slide against each other, the first terminal 20 is relatively displaced with respect to the second terminal 22 and the first connecting portion 26 is guided into the mating insertion hole 70 of the accommodating portion 68. By providing the tapered surface 72 in this way, the first connecting portion 26 of the first terminal 20 can be guided into the mating insertion hole 70.

Other Embodiments

The technique disclosed by this specification is not limited to the above described and illustrated embodiment. For example, the following various modes are also included.

(1) Although the biasing member in the above embodiment is the spring clip 24 made of SUS, the biasing member may be, for example, a spring clip constituted of a member made of copper alloy or a spring clip made of resin. Further, in the case of employing a spring clip made of resin, the spring clip may be integrally formed to the housing.

(2) Although the first contact portion 28 of the first terminal 20 and the second contact portion 32 of the second terminal 22 are directly in contact in the above embodiment, a separate contact spring may be provided between the first and second contact portions 28, 32 and the first and second contact portions 28, 32 may be in contact via the contact spring.

(3) Although the first contact portion 28 of the first terminal 20 and the second contact portion 32 of the second terminal 22 are plate-like in the above embodiment, a dome-shaped embossed contact point portion may be formed on at least either one of the first and second contact portions 28, 32.

(4) Although the insertion holes 54 are provided in the separate lid 52 in the above embodiment, the insertion holes 54 may be integrally provided in the housing 16.

(5) Although the length in the lateral direction of the second contact portion 32 is substantially equal to that of the first contact portion 28 in the above embodiment, a length in the lateral direction of a second contact portion may be longer than that of a first contact portion. In this way, a range in which a first terminal can be displaced in the lateral direction can be expanded.

(6) Although the insertion hole 54 of the lid 52 has the opening larger than the outer shape of the first connecting portion 26 and the outer peripheral edge 53 of the lid 52 comes into contact with the inner surface of the receptacle 42 in the above embodiment, an insertion hole of a lid may have an opening having substantially the same shape as the outer shape of a first connecting portion, the inner surface of an insertion hole of the lid may be in contact with the outer surface of the first connecting portion and a gap may be provided between the outer peripheral edge of the lid and the inner surface of a receptacle. In this way, if a first terminal is relatively displaced with respect to a second terminal, the lid is also relatively displaced and the outer peripheral edge of the lid comes into contact with the inner surface of the receptacle, whereby a displaceable range of the first terminal is restricted. Note that, in this case, the lid may be mounted on the first connecting portion, for example, by press-fitting the first connecting portion into the insertion hole of the lid or integrally forming the first connecting portion and the lid by insert molding.

LIST OF REFERENCE NUMERALS

10: connector device
12: connector
14: mating connector
16: housing
18: terminal
20: first terminal
22: second terminal
24: spring clip (biasing member)
26: first connecting portion
28: first contact portion
30: second connecting portion
32: second contact portion
34: first pressing portion
36: second pressing portion
38: coupling portion

42: receptacle
48: bottom surface
52: lid
53: outer peripheral edge
54: insertion hole
56: mating housing
58: mating terminal
62: mating receptacle
66: bottom surface
68: accommodating portion
70: mating insertion hole
72: tapered surface
74: first mating connecting portion (mating connecting portion)
G: gap

What is claimed is:

1. A connector, comprising:

a terminal constituted of a conductive metal member;

a housing made of resin, the terminal being accommodated into the housing; and a biasing member to be mounted on the terminal, wherein:

the terminal includes a plate-like first terminal including a first connecting portion to be connected to a mating connecting portion in a first direction and a first contact portion continuously provided from the first connecting portion, and a plate-like second terminal to be fixed to the housing and including a second contact portion disposed to be able to contact the first contact portion in the first direction, and the biasing member biases and electrically connects the first and second contact portions in directions opposite to each other by pressing the first contact portion in a direction from the first contact portion toward the second contact portion and pressing the second contact portion in a direction from the second contact portion toward the first contact portion and makes the first terminal relatively displaceable in a direction intersecting the first direction with respect to the second terminal.

2. The connector of claim 1, wherein:

the biasing member is a spring clip made of metal and configured to bias the first and second contact portions in directions opposite to each other by pressing the first contact portion in a direction from the first contact portion toward the second contact portion and pressing the second contact portion in a direction from the second contact portion toward the first contact portion, the spring clip includes a plate-like first pressing portion configured to press the first contact portion, a plate-like second pressing portion configured to press the second contact portion, and a coupling portion coupling the first and second pressing portions, and a gap is provided between the first contact portion and the coupling portion.

3. The connector of claim 1, wherein:

the housing includes an insertion hole larger than an outer shape of the first connecting portion, and the terminal restricts a displaceable range of the first terminal within a range of the insertion hole by being accommodated into the housing with the first connecting portion inserted into the insertion hole.

4. The connector of claim 3, wherein:

the housing includes a bottomed receptacle open in the first direction and a plate-like separate lid to be accommodated into the receptacle from the first direction, the first terminal is located in the receptacle and the biasing member is located between a bottom surface of the receptacle and the lid, and the lid is provided with the insertion hole and an outer peripheral edge of the lid is in contact with an inner surface of the receptacle.

5. A connector device, comprising:

the connector of claim 1; and a mating connector connectable to the connector in the first direction, wherein:

the mating connector includes a mating housing to be connected to the housing, the mating housing includes a bottomed mating receptacle open in a second direction opposite to the first direction, the receptacle of the housing being accommodated into the mating receptacle when the housing and the mating housing are connected, and an accommodating portion projecting in the second direction from a bottom surface of the mating receptacle, the mating connecting portion being accommodated into the accommodating portion, a mating insertion hole into which the first connecting portion is inserted is provided to be open in an end surface in the second direction of the accommodating portion, and a tapered surface expanded in the second direction and configured to guide the first connecting portion into the mating insertion hole is provided on an opening edge part of the mating insertion hole.

* * * * *